US007131155B1

(12) United States Patent
Fernandez et al.

(10) Patent No.: US 7,131,155 B1
(45) Date of Patent: Nov. 7, 2006

(54) DIAPER CHANGING BENCH FOR PUBLIC USE

(76) Inventors: Ruben B Fernandez, 2457 Airport Thruway #118, Columbus, GA (US) 31904-9053; Judith N Fernandez, 2457 Airport Thruway #118, Columbus, GA (US) 31904-9053

( * ) Notice: Subject to any disclaimer, the term of this patent is extended or adjusted under 35 U.S.C. 154(b) by 137 days.

(21) Appl. No.: 10/929,876

(22) Filed: Aug. 30, 2004

Related U.S. Application Data

(60) Provisional application No. 60/481,364, filed on Sep. 12, 2003.

(51) Int. Cl.
*A47D 5/00* (2006.01)
*A47D 7/00* (2006.01)
*A47B 3/00* (2006.01)

(52) U.S. Cl. ..... 5/655; 5/136; 108/35

(58) Field of Classification Search ..... 5/655, 5/947, 133, 136; D6/555; 108/33–35; 312/246, 312/248

See application file for complete search history.

(56) References Cited

U.S. PATENT DOCUMENTS

| | | | | | |
|---|---|---|---|---|---|
| 128,569 | A | | 7/1872 | Vallett | 108/48 |
| 1,582,380 | A | | 4/1926 | Carpenter et al. | 297/163 |
| 2,943,896 | A | | 7/1960 | Gaston | 108/134 |
| 3,696,762 | A | | 10/1972 | Holdham | 108/134 |
| 3,730,107 | A | | 5/1973 | Bergkamp et al. | 108/39 |
| 4,136,622 | A | | 1/1979 | Bue et al. | 108/48 |
| 4,216,951 | A | | 8/1980 | Griffin | 5/655 |
| 4,573,608 | A | * | 3/1986 | Hansen | 221/92 |
| D302,088 | S | | 7/1989 | Burt | D6/555 |
| 4,876,970 | A | * | 10/1989 | Bolduc | 108/35 |
| 4,965,896 | A | | 10/1990 | Berger et al. | 5/424 |
| D314,112 | S | * | 1/1991 | Dainty | D6/555 |
| 5,081,724 | A | * | 1/1992 | Takahashi et al. | 5/136 |
| 5,086,527 | A | * | 2/1992 | Takahashi et al. | 5/136 |
| D326,384 | S | | 5/1992 | Burt et al. | D6/555 |
| 5,707,126 | A | * | 1/1998 | Neufeld et al. | 312/245 |
| D391,794 | S | * | 3/1998 | Helmsderfer | D6/555 |
| 5,754,999 | A | | 5/1998 | Helmsderfer | 5/655 |
| D397,893 | S | * | 9/1998 | Helmsderfer | D6/555 |
| 5,864,905 | A | | 2/1999 | Helmsderfer | 5/655 |
| D408,190 | S | * | 4/1999 | Helmsderfer et al. | D6/555 |
| 5,906,015 | A | | 5/1999 | Hilger et al. | 5/136 |
| D412,258 | S | * | 7/1999 | Helmsderfer et al. | D6/555 |
| D416,155 | S | * | 11/1999 | Helmsderfer et al. | D6/555 |
| 6,032,310 | A | | 3/2000 | Helmsderfer et al. | 5/655 |

(Continued)

FOREIGN PATENT DOCUMENTS

| | | |
|---|---|---|
| EP | 1300104 | 4/2003 |

(Continued)

*Primary Examiner*—Robert G. Santos
(74) *Attorney, Agent, or Firm*—Michael I Kroll

(57) ABSTRACT

An apparatus for a diaper changing table 12 that can be selectively deployed by individuals 14 to aid in their toiletry needs. While the device 10 can be installed in any bathroom 16, preferably it is intended to be installed in public bathrooms whereby, in addition to the normal infant-child needs, adults, seniors and the disabled are afforded privacy in conducting their toiletry needs thereby resulting in an opportunity for them to experience integration and participation in society. The device 10 accommodates a full-sized adult 14 (length and weight wise) by providing a housing frame 20 that is fixedly fastened to the floor 18, as opposed to the walls, which results in a device with a small foot print having a handle 30 for pivotally deploying the table portion 12 having a plurality of cantilevered support members with integral tensioning members aiding in the deployment.

9 Claims, 7 Drawing Sheets

U.S. PATENT DOCUMENTS

| | | | | |
|---|---|---|---|---|
| 6,049,928 | A | 4/2000 | Helmsderfer | 5/655 |
| 6,055,688 | A * | 5/2000 | Helmsderfer et al. | 5/655 |
| 6,151,737 | A | 11/2000 | Henninge | 5/655 |
| 6,269,503 | B1 * | 8/2001 | Betker | 5/655 |
| 6,343,834 | B1 | 2/2002 | Wurmlinger | 297/14 |

FOREIGN PATENT DOCUMENTS

| | | | |
|---|---|---|---|
| JP | 01101928 | A * | 4/1989 |
| JP | 2002034734 | | 2/2002 |

* cited by examiner

DIAPER CHANGING BENCH FOR PUBLIC USE

RELATED APPLICATIONS

This application is subject to U.S. provisional application Ser. No. 60/481,364 filed 12 Sep. 2003.

Please incorporate by reference all information in said provisional application into this instant application.

BACKGROUND OF THE INVENTION

1. Field of the Invention

The present invention relates generally to changing tables and, more specifically, a diaper changing table that can be selectively deployed by individuals to aid in their toiletry needs. While the device can be installed in any bathroom, preferably it is intended to be installed in public bathrooms whereby, in addition to the normal infant-child needs adults, seniors and the disabled are afforded privacy in conducting their toiletry needs thereby resulting in an opportunity for them to experience integration and participation in society. The device accommodates a full-sized adult (length and weight wise) by providing a frame that is fixedly fastened to the floor, as opposed to the walls, which results in a device with a small foot print having a handle for pivotally deploying the table portion having a plurality of cantilevered support members with integral tensioning members aiding in said deployment.

2. Description of the Prior Art

There are other changing tables designed for a similar purpose. Typical of these is U.S. Pat. No. 128,569 issued to Vallett on Jul. 2, 1872.

Another patent was issued to Carpenter, et al on Apr. 27, 1926 as U.S. Pat. No. 1,582,380. Yet another U.S. Pat. No. 2,943,896 was issued to Gaston on Jul. 5, 1960 and still yet another was issued on Oct. 10, 1972 to Holdham as U.S. Pat. No. 3,696,762.

Another patent was issued to Bergkamp, et al. on May 1, 1973 as U.S. Pat. No. 3,730,107. Yet another U.S. Pat. No. 4,136,622 was issued to Bue, et al. on Jan. 30, 1979. Another was issued to Griffin on Aug. 12, 1980 as U.S. Pat. No. 4,216,951 and still yet another was issued on Oct. 30, 1990 to Berger, et al. as U.S. Pat. No. 4,965,896.

Another patent was issued to Helmsderfer on May 26, 1998 as U.S. Pat. No. 5,754,999. Yet another U.S. Pat. No. 5,864,905 was issued to Helmsderfer on Feb. 2, 1999. Another was issued to Hilger, et al. on May 25, 1999 as U.S. Pat. No. 5,906,015 and still yet another was issued on Mar. 7, 2000 to Helmsderfer, et al. as U.S. Pat. No. 6,032,310.

Another patent was issued to Helmsderfer on Apr. 18, 2000 as U.S. Pat. No. 6,049,928. Yet another U.S. Pat. No. 6,151,737 was issued to Henninge on Nov. 28, 2000. Another was issued to Wurmlinger on Feb. 5, 2002 as U.S. Pat. No. 6,343,834 and still yet another was issued on Jul. 11, 1989 to Burt as U.S. Pat. No. Des. 302,088.

Another patent was issued to Burt, et al. on May 26, 1992 as U.S. Pat. No. Des. 326,384. Yet another European Publication No. EP1300104 was issued to Gentil on Apr. 9, 2003 and another Japanese Patent was issued to Aono on Feb. 5, 2002 as Japanese Patent No. JP2002034734.

U.S. Pat. No. 128,569

Inventor: Leander N. Vallett

Issued: Jul. 2, 1872

The combination of the hooks and tenoned brace with the board provided with the sockets a and ears, all arranged as shown and described.

U.S. Pat. No. 1,582,380

Inventor: Herbert W. Carpenter, et al

Issued: Apr. 27, 1926

A folding table for automobiles comprising a substantially U-shaped frame adapted to be secured to the back of the front seat of an automobile, a table top hinged at its upper edge to the upper ends of the arms of the U-shaped frame, said table top adapted to fit against the frame when in its downward inoperative, position, and bracing means for supporting the table top in its raised level position, the same comprising a pair of flat bar members hingedly secured together at their inner adjacent ends, a pair of slotted arms secured at their outer ends to the free portion of the table top and the base of the substantially U-shaped frame respectively, reduced extensions formed on the outer ends of said flat bar members and slidable in the respective slotted arms, and means for adjustably securing the reduced extensions of the bar members in the respective slotted arms.

U.S. Pat. No. 2,943,896

Inventor: Paul S. Gaston

Issued: Jul. 5, 1960

A collapsible supporting device for drop leaves, comprising a mounting plate adapted to be secured to the underside of a drop leaf, a plurality of foldable struts disposed in mutually spaced relation transversely of said mounting plate and extending obliquely therefrom s to a side support, means pivotally connecting upper ends of said struts to the mounting plate, means provided at the lower ends of the struts for pivotally connecting; the frame to a side support, said, struts being automatically lockable in their drop leaf supporting position, and means for unlocking the struts to facilitate folding thereof and lowering of the drop leaf; said last mentioned means comprising a substantially U-shaped: rod, a pair of coaxial end portions provided on said rod and pivotally connected to said struts, a detent provided on said mounting plate and engageable by the bight portion of said rod when the drop leaf is raised, said bight portion of the rod being movable beyond said detent to effect folding of said struts, an unlocking bar slidably attached to said mounting plate and engaging the bight portion of said rod for moving the same beyond the detent, and a keeper strap provided on the mounting plate adjacent but spaced from said detent the bight portion of said rod extending through the space between the detent and said keeper strap and being sustained in engagement with the former by the latter.

U.S. Pat. No. 3,696,762

Inventor: Bertram Roy Holdham

Issued: Oct. 10, 1972

The invention provides a foldable platform device comprising a platform having an end for linear guidance by a guideway between an out-of-use position of the platform and an in-use position of the platform, a guideway for so guiding said platform end, a support member for the platform which support member will extend between the platform and a platform support and will move with the platform between the platform out-of-use and in-use positions, and biasing means operatively connected to the support member for having a controlling influence over movement of the platform between its out-of-use and in-use positions.

U.S. Pat. No. 3,730,107

Inventor: Robert L. Bergkamp, et al.

Issued: May 1, 1973

A bracket mechanism including an upper brace and a lower brace for mounting a support member, such as an ironing board, desk, table, drawing board, or the like, in either a substantially horizontal operative position or a substantially upright inoperative position. The braces are mounted for swinging movement in a cabinet in which the bracket mechanism and support member are stored, in the folded positions of said parts. The cabinet also provides in part a support for the swingably mounted braces. A latch means retains the support member and braces in the operative positions of said parts and is manually releasable to enable said parts to swing to folded storage positions.

U.S. Pat. No. 4,136,622

Inventor: Richard C. Bue, et al.

Issued: Jan. 30, 1979

A table surface member is movable between a vertical storage position against a wall and a usable positioned horizontally extending from the wall. The table member connects to the wall by means of a hinge assembly which permits folding of the table such that the upper edge of the table in the storage position is the edge adjacent the wall in the usable position. In a preferred embodiment latch means are provided for latching the edge of the table to the wall or wall mounting bracket in the usable position, so that no supporting legs for the outer end of the table are required. Alternatively, another disclosed embodiment uses folding legs to support the outer edge of the table in the usable position. A preferred hinge assembly includes upper and lower hinge arms pivotally connecting to the wall and the table. The pivotal axis of the lower arm or arms to the table is spaced below a plane passing through the pivot axis of the upper arm to the table and parallel with the table surface. This offset plus intentional length mismatching of the hinge arms provides an overcenter resistance force which holds the table in its storage position without the need for a separate latch or counterbalance.

U.S. Pat. No. 4,216,951

Inventor: Barbara J. Griffin

Issued: Aug. 12, 1980

A baby-changing apparatus for use in public rest rooms or other places where space is limited is provided with a padded table bearing a roll of paper and a cutting and retaining bar, which can be positioned parallel to a vertical mounting surface when not in use, or supported and retained in a horizontal position for use by a hinged bracket with a vertical projection at its outermost end, which bears against the outermost edge of the table and prevents unintentional movement of the bracket. The roll of paper and cutting and retaining bar are adapted to provide a clean table surface prior to use. The table is provided with a safety belt with a tongueless friction buckle.

U.S. Pat. No. 4,965,896

Inventor: Frederick Berger, et al.

Issued: Oct. 30, 1990

A fold-up table adapted to facilitate the process of changing a baby's diaper. The table includes a hollow rectangular tray that can be swung down to a horizontal position extending outwardly from a room wall to support a baby while the diaper is being changed. During non-use periods the tray can be swung to an upright position facing the room wall surface.

U.S. Pat. No. 5,754,999

Inventor: John A Helmsderfer

Issued: May 26, 1998

A baby diaper changing station comprises a base and a support platform hingedly mounted at one side to the base and a rail structure on at least one side of the platform to increase the effective depth of the platform. A utility channel surrounds the platform for holding various diaper changing supplies and removable protective panels are positioned on bottom and side surfaces of the platform to reduce vandalism damage. A waste chute is formed in the base or support platform of the diaper changing station and cooperates with a waste receptacle proximate the station for receiving used diapers and other related waste. Accessory hooks on the platform are configured to receive and hold diaper changing supplies, such as a diaper bag. An alternative embodiment of the diaper changing station utilizes a platform having nested sections which telescope to increase the effective depth of the platform.

U.S. Pat. No. 5,864,905

Inventor: John A Helmsderfer

Issued: Feb. 2, 1999

A baby diaper changing station comprises a base structure and a support platform hingedly coupled to the base structure. An insulative surface of plastic material is mounted in a trough defined by the support platform and includes a curved portion which extends into the trough to receive a baby. A handle is positioned in the support platform and also extends into the trough opposite the insulative surface. The curved portion extends into the trough and slopes inwardly and transversely to define a space to receive the handle to thereby prevent interference with the handle and to maintain an effective depth in the trough.

U.S. Pat. No. 5,906,015

Inventor: Jeff H. Hilger, et al.

Issued: May 25, 1999

A wall-mounted infant changing apparatus configured to provide a relatively uniform surface in an open position for cleaning of the apparatus. The infant changing apparatus includes a support frame, a bed, a hinge means and a drive cylinder. The bed is pivotably attached to the support frame by the hinge means. The drive cylinder is also attached to the support frame and the bed to provide controlled movement of the bed from a closed position to the open position. A retaining end of the support frame and a pivot end of the bed are configured for mating interaction such that in the open position, the hinge means and the drive cylinder are shielded from waste material.

U.S. Pat. No. 6,032,310

Inventor: John A Helmsderfer

Issued: Mar. 7, 2000

A wall-mounted station for changing the diapers of a baby comprises a base configured for being vertically mounted to a wall and defining a base plane and a baby platform hingedly mounted to the base and defining a platform plane. The baby platform is operable for being movable between an opened position wherein the platform plane is disposed generally perpendicular to the base plane for the platform to receive a baby and a closed position wherein the platform plane is generally parallel to the base plane. A stop mechanism secures the platform generally perpendicular to the base in the opened position. A flange positioned around a periphery of the base is configured for engaging a wall when the base is inset therein for covering an exposed edge of the wall and stabilizing the base in the wall.

U.S. Pat. No. 6,049,928

Inventor: John A Helmsderfer

Issued: Apr. 18, 2000

A baby diaper changing station comprises a base and a support platform hingedly mounted at one side to the base and a rail structure on at least one side of the platform to increase the effective depth of the platform. A utility channel surrounds the platform for holding various diaper changing supplies and removable protective panels are positioned on bottom and side surfaces of the platform to reduce vandalism damage. A waste chute is formed in the base or support platform of the diaper changing station and cooperates with a waste receptacle proximate the station for receiving used diapers and other related waste. Accessory hooks on the platform are configured to receive and hold diaper changing supplies, such as a diaper bag. An alternative embodiment of the diaper changing station utilizes a platform having nested sections which telescope to increase the effective depth of the platform.

U.S. Pat. No. 6,151,737

Inventor: Paul Henninge

Issued: Nov. 28, 2000

A baby changing station includes a platform coupled by a hinge to a wall structure. The platform is movable between a closed position and an open position. The interlocking configuration of the hinge and the combination of the geometries of the platform, the wall structure and a wall portion result in a baby changing station which is sturdy and is not susceptible to contamination, given the blow-molded parts. The platform is hollow and includes a trough for receiving a baby when in the open position. The wall structure is smaller than the platform in order to be nested within the platform when in the closed position. The blow-molded hinge configuration eliminates the use of a steel pin or rod generally used in the art to strengthen the hinge. The baby changing station of the present invention provides a secure interface which may be easily cleaned and maintained and is less subject to structural damage. The hinge is further provided with at least one stop, and preferably five, which prevent the platform from rotating beyond the open position.

U.S. Pat. No. 6,343,834

Inventor: Ernest H. Wurmlinger

Issued: Feb. 5, 2002

A collapsible wall mounted seat comprising a linkage mount for fixing to a wall, a seat for supporting a person, and a linkage connecting the seat to the linkage mount. The linkage includes a first end and a second end and is connected at the first end to the linkage mount and at the second end to the seat. The linkage is movable between a folded position with the seat lying adjacent and substantially parallel to the wall, and an extended position with the seat extending outwards from and substantially perpendicular to the wall. The collapsible wall mounted seat includes a releasable lock for unlocking the linkage in the extended position.

U.S. Pat. No. Des. 302,088

Inventor: Timothy P. Burt

Issued: Jul. 11, 1989

The ornamental design for a wall-mounted diaper changing table, as shown and described.

U.S. Pat. No. Des. 326,384

Inventor: Timothy P. Burt

Issued: May 26, 1992

The ornamental design for a fold down, wall-mounted diaper changing table, as shown and described.

European Regional Publication Number EP 1300104

Inventor: Jean-Luc Gentil

Published: Apr. 9, 2003

The baby clothes changing table has a frame and a movable table surface movable between two stable positions, including a stable horizontal position and a released position. The table has a lock to hold it in at least one of the stable positions to selectively prevent its movement when a weight greater than a predetermined value is applied.

Japanese Patent Number JP200234734

Inventor: Hiroshi Aono

Published: Feb. 5, 2002

PROBLEM TO BE SOLVED: To provide a bed for changing a diaper which is provided with an infant binding device by which an infant is protected from easily falling.

SOLUTION: This bed for changing a diaper comprises a pedestal, a cushion mat to be mounted and fixed on the upper part of the pedestal and a binding belt. Since a non-slip part is provided at nearly central part of the cushion mat and the area of the cushion mat on which foots are placed is composed of a slippery material, even if the infant laid on the bed for diaper changing tries to kick up, slip up or roll over, he/she is hard to put power on the mat, and also since infant's waist and back are placed on the non-slip part, it is possible to bind the infant safely and surely.

While these changing table devices may be suitable for the purposes for which they were designed, they would not be as suitable for the purposes of the present invention, as hereinafter described.

The present invention provides a foldable changing table that accommodates a full-sized adult (length and weight capacity) compared to other devices that are only suitable for infants and very small children. The device can be installed in public restrooms affording adults, seniors and the disabled with suitable facilities for their toiletry needs.

SUMMARY OF THE PRESENT INVENTION

The present invention discloses a diaper changing table that can be selectively deployed by individuals to aid in their toiletry needs. While the device can be installed in any bathroom, preferably it is intended to be installed in public bathrooms whereby, in addition to the normal infant-child needs, adults, seniors and the disabled are afforded privacy in conducting their toiletry needs thereby resulting in an opportunity for them to experience integration and participation in society. The device accommodates a full-sized adult (length and weight wise) by providing a housing frame that is fixedly fastened to the floor, as opposed to the walls, which results in a device with a small foot print having a handle for pivotally deploying the table portion having a plurality of cantilevered support members with integral tensioning members aiding in the deployment.

A primary object of the present invention is to provide a changing bench that enables individuals to utilize a public restroom and address personal toilet needs, while maintaining privacy and dignity resulting in an opportunity to experience integration and participation in society.

Another object of the present invention is to provide a diaper changing bench that is designed to assist in the toileting needs of individuals including infants, children, adults, seniors and the disabled.

Yet another object of the present invention is to provide a diaper changing bench that is preferably installed inside the stalls of public restrooms.

Still yet another object of the present invention is to provide a diaper changing bench having a frame that is fixedly fastened to the rather than the walls.

Another object of the present invention is to provide a changing bench having a handle for pivotally extending and retracting the table member.

Yet another object of the present invention is to provide a changing bench that can be selectively deployed by a user as needed.

Still yet another object of the present invention is to provide a changing bench that will not interfere with the normal functions of the toilet.

Another object of the present invention is to provide a changing bench that can be situated whereby persons with disabilities can move from the bench to the toilet and vise-versa.

Another object of the present invention is to provide a diaper changing bench that is easy to use for disabled people and/or their caregivers.

Additional objects of the present invention will appear as the description proceeds.

The present invention overcomes the shortcomings of the prior art by providing a diaper changing bench that can be selectively deployed by individuals to aid in their toiletry needs. While the device can be installed in any bathroom, preferably it is intended to be installed in public bathrooms whereby, in addition to the normal infant-child needs adults, seniors and the disabled are afforded privacy in conducting their toiletry needs thereby resulting in an opportunity for them to experience integration and participation in society. The device accommodates a full-sized adult (length and weight wise) by providing a frame that is fixedly fastened to the floor, as opposed to the walls, which results in a device with a small foot print having a handle for pivotally deploying the table portion having a plurality of cantilevered support members with integral tensioning members aiding in said deployment.

The foregoing and other objects and advantages will appear from the description to follow. In the description reference is made to the accompanying drawings, which form a part hereof, and in which is shown by way of illustration-specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
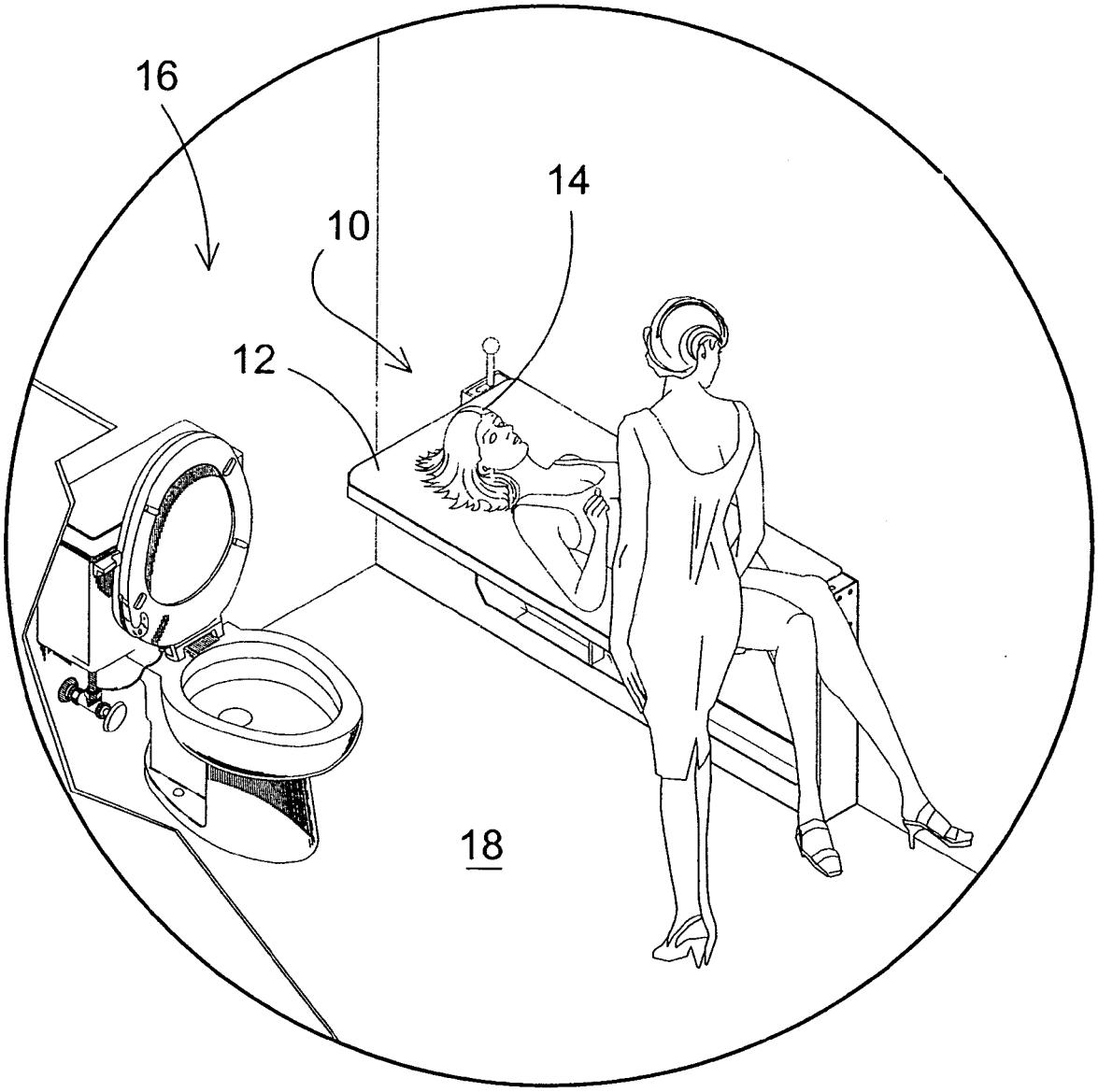
FIG. 1 is an illustrative view of the present invention in use.

With regard to reference numerals used, the following numbering is used throughout the drawings.

| | |
|---|---|
| 10 | present invention |
| 12 | bench |
| 14 | user |
| 16 | restroom |
| 18 | floor |
| 20 | housing |
| 22 | seat belt |
| 24 | mat |
| 26 | decal |
| 28 | latch |
| 30 | release knob |
| 32 | release rod |
| 34 | pivot supports |
| 36 | support |
| 38 | seat support |
| 40 | seat gussets |
| 42 | pivot rod |
| 44 | gas spring |
| 46 | gas spring bracket |
| 48 | release lever assembly |
| 50 | center seat support |

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. The present invention 10 discloses a diaper changing bench 12 that enables individuals 14 with disabilities to utilize a public restroom 16 and address personal toilet needs while maintaining privacy and dignity resulting in an opportunity to experience integration and participation in society. The device 10 is designed to assist in the toileting needs of individuals 14 with disabilities but may be used by seniors and children. The device 10 is intended to be installed inside the accessible stalls of public restrooms 16 and is bolted to the floor 18.

Figure 2:
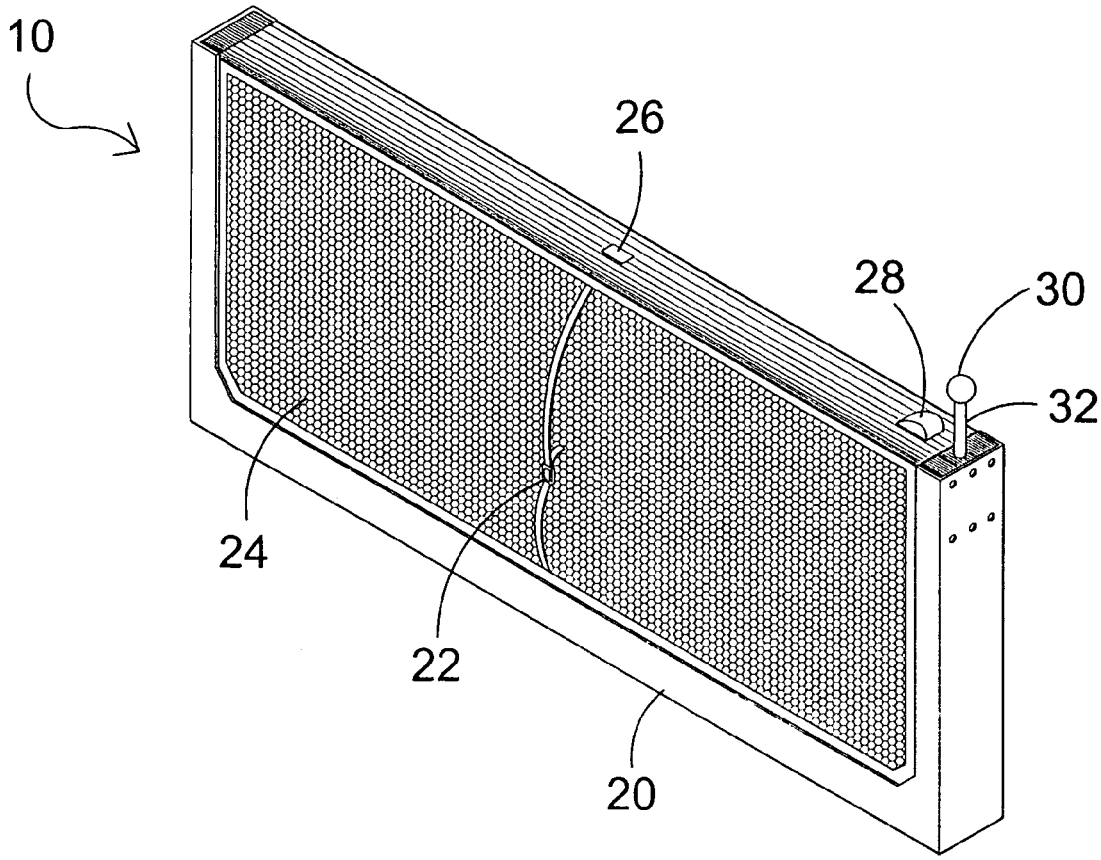
FIG. 2 is a front perspective view of the present invention in a closed position.

Turning to FIG. 2, shown therein is a front perspective view of the present invention 10 in a closed position. Shown is a front perspective view of the present invention 10 disclosing a diaper changing bench that enables individuals with disabilities to utilize a public restroom and address personal toilet needs while maintaining privacy and dignity resulting in an opportunity to experience integration and participation in society. The device 10 is designed to assist in the toileting needs of individuals with disabilities but may be used by seniors and children. The device 10 is intended to be installed inside the accessible stalls of public restrooms and is bolted to the floor. Also shown are the housing 20, seat belt 22, mat 24, decal 26 mounted on the cover of the device, latch 28, release knob 30 and release rod 32 which can be installed in either end of the bench depending on the space available.

Figure 3:
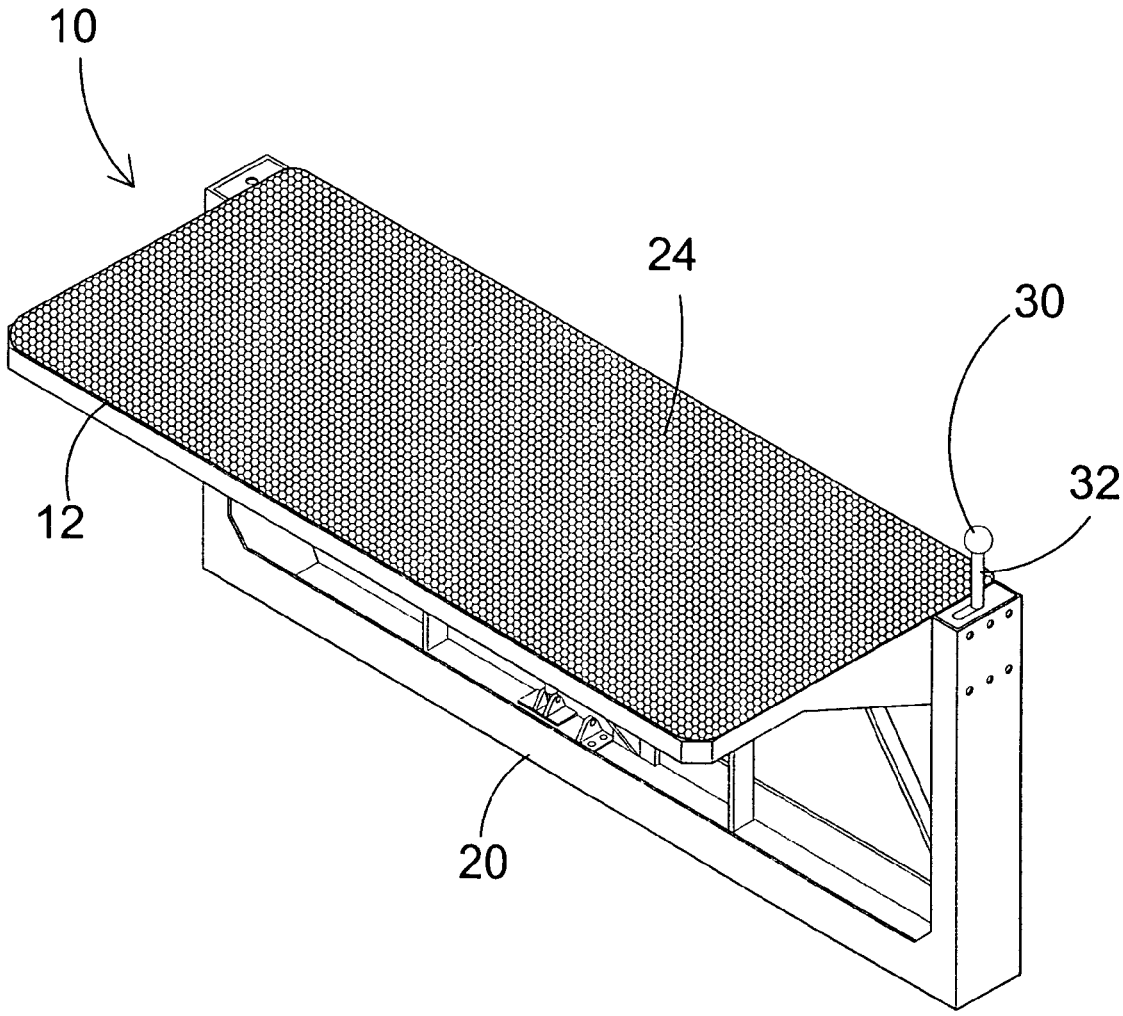
FIG. 3 is a front perspective view of the present invention in an open position.

Turning to FIG. 3, shown therein is a front perspective view of the present invention 10 in an open position. Shown is a front perspective view of the present invention 10 disclosing a diaper changing bench 12 that enables individuals with disabilities to utilize a public restroom and address personal toilet needs while maintaining privacy and dignity resulting in an opportunity to experience integration and participation in society. The device 10 is designed to assist in the toileting needs of individuals with disabilities but may be used by seniors and children. The device 10 is intended to be installed inside the accessible stalls of public restrooms and is bolted to the floor. Also shown are the housing 20, mat 24, release rod 32 and knob 30.

Figure 4:
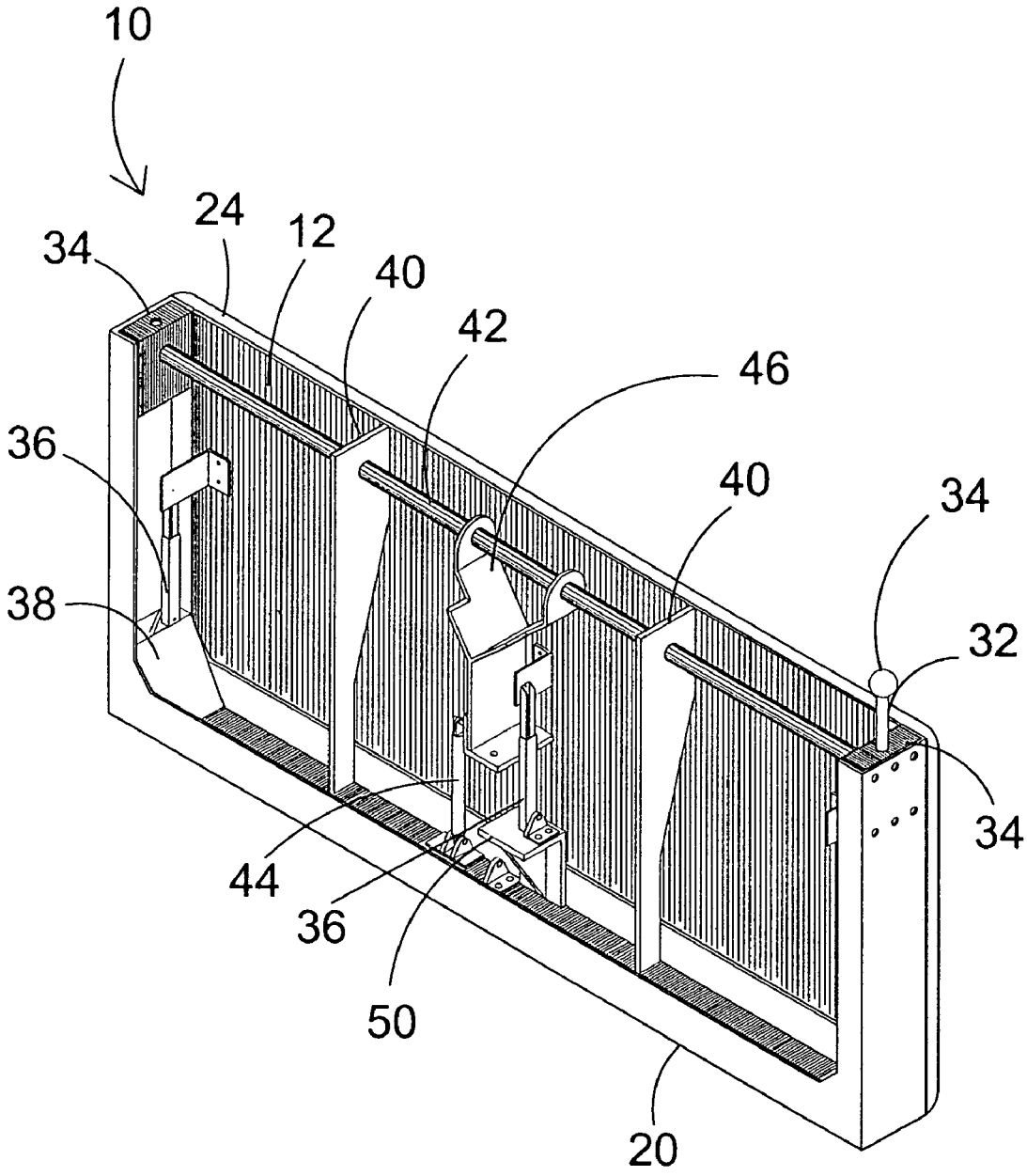
FIG. 4 is a rear perspective view of the present invention.

Turning to FIG. 4, shown therein is a rear perspective view of the present invention 10. Shown is a rear perspective view of the present invention 10 disclosing a diaper changing bench 12 with mat 24 that enables individuals with disabilities to utilize a public restroom and address personal toilet needs while maintaining privacy and dignity resulting in an opportunity to experience integration and participation in society. The device 10 is designed to assist in the toileting needs of individuals with disabilities but may be used by seniors and children. The device 10 is intended to be installed inside the accessible stalls of public restrooms and is bolted to the floor. Also shown are the left and right seat pivot supports 34, the U-shaped housing 20, multiple supports 36, left housing seat support 38, seat gussets 40, seat pivot rod 42, gas spring 44 with bracket 46, center housing seat support 50, release rod 32 and knob 34.

Figure 5:
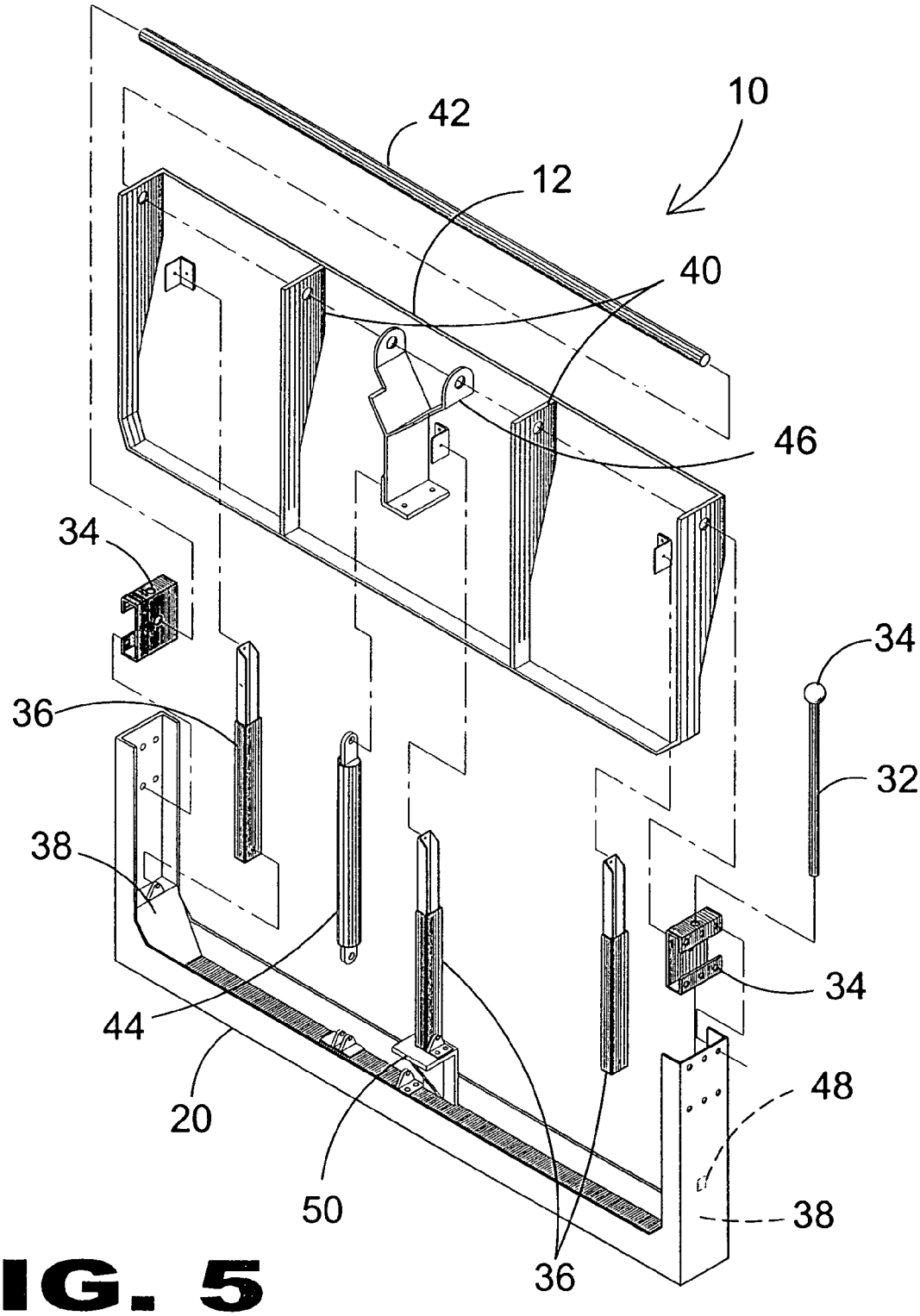
FIG. 5 is an exploded view of the present invention.

Turning to FIG. 5, shown therein is an exploded view of the present invention 10. Shown is an exploded view of the present invention 10 disclosing a diaper changing bench or seat 12 that enables individuals with disabilities to utilize a public restroom and address personal toilet needs while maintaining privacy and dignity resulting in an opportunity to experience integration and participation in society. The device 10 is designed to assist in the toileting needs of individuals with disabilities but may be used by seniors and children. The device 10 is intended to be installed inside the accessible stalls of public restrooms and is bolted to the floor. Also shown are the left and right seat pivot supports 34, housing 20, multiple supports 36, left and right housing seat supports 38, seat gussets 40, seat pivot rod 42, gas spring 44 with bracket 46, center housing seat support 50, release rod 32 and knob 34. Also shown is release lever assembly 48.

Figure 6:
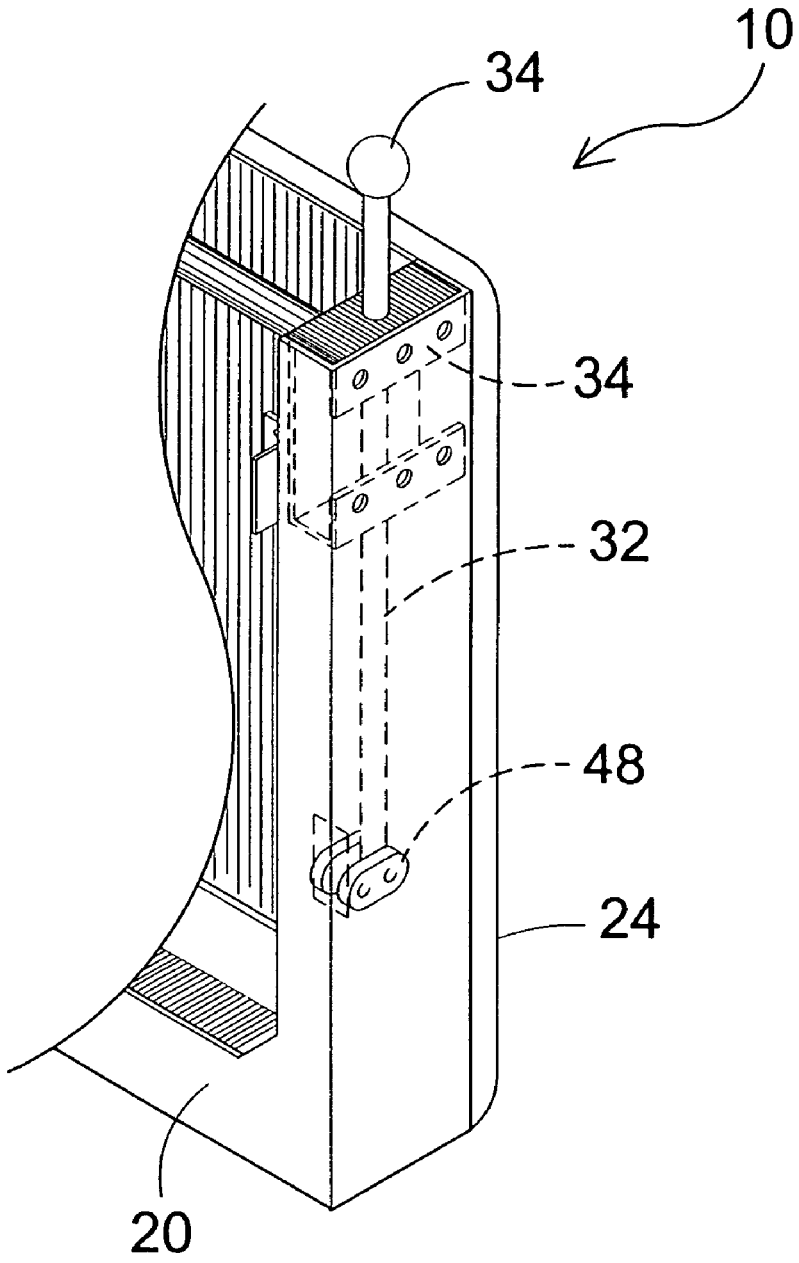
FIG. 6 is a detailed view of the present invention.

Turning to FIG. 6, shown therein is a detailed view of the present invention 10. Shown is a detailed view of the present invention 10 disclosing a diaper changing bench that enables individuals with disabilities to utilize a public restroom and address personal toilet needs while maintaining privacy and dignity resulting in an opportunity to experience integration and participation in society. The device 10 is designed to assist in the toileting needs of individuals with disabilities but may be used by seniors and children. The device 10 is intended to be installed inside the accessible stalls of public restrooms and is bolted to the floor. Shown are the release lever assembly 48 and other previously disclosed elements.

Figure 7:
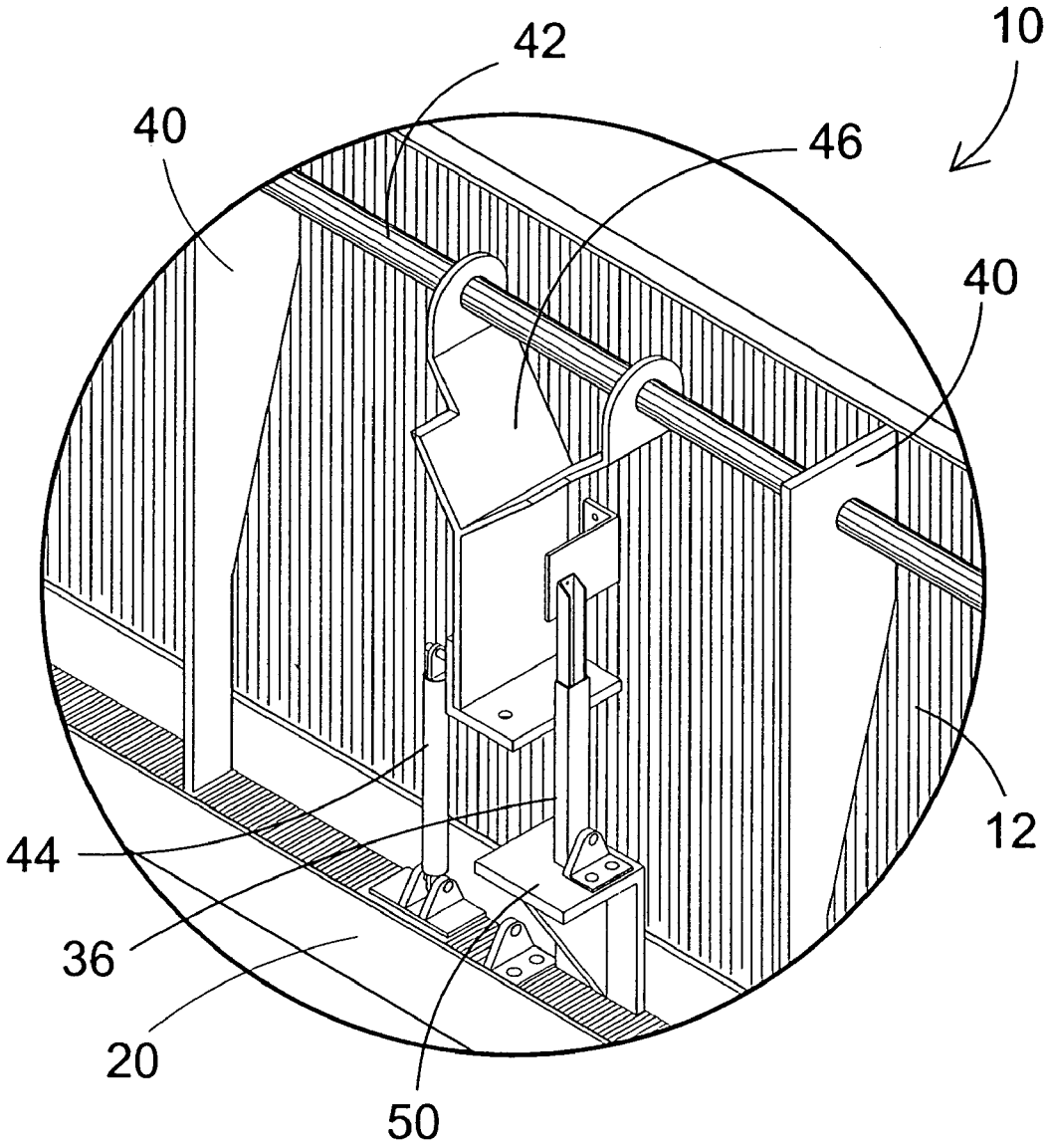
FIG. 7 is a detailed view of the present invention.

Turning to FIG. 7, shown therein is a detailed view of the present invention 10. Shown is a detailed view of the present invention 10 disclosing a diaper changing bench 12 that enables individuals with disabilities to utilize a public restroom and address personal toilet needs while maintaining privacy and dignity resulting in an opportunity to experience integration and participation in society. The device 10 is designed to assist in the toileting needs of individuals with disabilities but may be used by seniors and children. The device 10 is intended to be installed inside the accessible stalls of public restrooms and is bolted to the floor. Other previously disclosed elements are also shown.

We claim:

1. A bench for changing diapers for mounting on the floor of a public restroom, comprising:

a) a housing, said housing having first and second generally upright standing support members wherein one of each upright members is disposed on each end of an elongated base member wherein a substantially U-shaped housing is formed, wherein said base member has a front and rear surface and a bottom, said bottom for being mounted to the floor of the restroom, wherein said first and second upright members have a front and rear surface and a first end connected to said base member and a second end extending away from said base member, wherein said base member and said first and second upright members have an inner surface;

b) a bench being foldably disposed on said housing so that said bench is folded for storage in a first position and folded out to form a substantially horizontal bench for use in a second position, said bench having a top and a bottom surface, a first and second end, and a first and second side;

c) means for attaching said bench to said housing whereby the bench can be folded for storage in a first position and folded out for usage in a second position; and;

d) means for releasably securing said bench to said housing whereby the bench can be folded and latched for storage in a first position and then released and folded out for usage in a second position; and e) a mat being disposed on said top surface of said bench to provide a cushion for a user, wherein said base member is bolted to the floor of the restroom to permit the bench to be mounted to the floor of a restroom and said means for attaching said bench to said housing comprises:

i) a rod having a first end attached to said second end of said first upright support member and having a second end attached to said second end of said second upright support member wherein said rod is substantially horizontally disposed; and ii) a plurality of gussets being disposed on said bottom surface of said bench, wherein each of said gussets has an aperture therein, wherein said rod extends through each of said apertures so that said rod rotates in said apertures, wherein said bench is foldably attached to said housing to permit the bench to be folded for storage in a first position and folded out for usage in a second position.

2. The bench of claim 1, further comprising a plurality of bench supports being disposed on said bottom surface of said bench, wherein a first end is pivotally attached to said bottom surface of said bench and a second end is pivotally attached to said housing so as to provide support to said bench when said bench is in said second position.

3. The bench of claim 2, further comprising at least one tensioning member being disposed on said bottom surface of said bench so as to bias said bench toward said second position so as to aid in moving said bench from said first position to said second position.

4. The bench of claim 3, wherein said tensioning member comprises a gas spring having a first end pivotally attached to said bottom surface of said bench and a second end pivotally attached to said housing.

5. The bench of claim 4, wherein said means for releasably securing said bench to said housing comprises:

a) a release rod being disposed on one of said first or second upright support members, said release rod having first and second ends;

b) a release knob being disposed on said first end of said release rod to permit a user to grasp the knob;

c) a release lever assembly being disposed on said second end of said release rod, wherein said release lever assembly allows said release rod to pivot from a first position to a second position; and, d) wherein said bench can be folded and secured for storage when said release rod is in said first position and said bench can be folded out for storage when said release rod is in said second position.

6. The bench of claim 5, wherein said release rod can be disposed on said first or second upright support member.

7. The bench of claim 5, wherein said release rod can be latched in said first position and then unlatched for movement to said second position.

8. The bench of claim 7, further comprising a seat belt being disposed on said top of said bench for being worn by a user.

9. The bench of claim 8, further comprising a cover being disposed on said housing, wherein said cover extends between said first and second upright members.

* * * * *